US006623342B1

(12) United States Patent
McDonald

(10) Patent No.: US 6,623,342 B1
(45) Date of Patent: Sep. 23, 2003

(54) SUPPORT ACCESSORY FOR POWER HAND TOOL

(75) Inventor: Jon Anthony McDonald, Woodland Hills, CA (US)

(73) Assignee: Pearl Abrasive Company, Commerce, CA (US)

( * ) Notice: Subject to any disclaimer, the term of this patent is extended or adjusted under 35 U.S.C. 154(b) by 0 days.

(21) Appl. No.: 10/087,199

(22) Filed: Mar. 2, 2002

(51) Int. Cl.[7] ..... B24B 41/00
(52) U.S. Cl. ..... 451/360; 451/449
(58) Field of Search ..... 451/360, 342, 451/351, 352, 353, 361, 363, 449; 125/4, 13.01, 13.03, 14

(56) References Cited

U.S. PATENT DOCUMENTS 3,896,783 A * 7/1975 Manning ..... 125/13.01
4,236,356 A * 12/1980 Ward ..... 451/352
5,540,210 A * 7/1996 Jones ..... 125/13.01
5,788,561 A * 8/1998 Pearlman et al. ..... 451/353
5,803,071 A * 9/1998 Chiuminatta et al. .... 125/13.01
6,349,712 B1 * 2/2002 Halstead ..... 125/12

* cited by examiner

*Primary Examiner*—Dung Van Nguyen
(74) *Attorney, Agent, or Firm*—Marshall E. Rosenberg

(57) ABSTRACT

An accessory for a power hand tool including a rolling support structure for supporting and carrying the hand tool over a substrate at a user-selected or preselected working depth or height of the disc grinder or sander or similar material processor is disclosed. The accessory includes a support bracket having a longitudinal axis for attachment to a portion of the housing at an intermediate position of the support bracket, together with a pair of substrate-surface engaging rollers adjustably secured to the support bracket at mounting locations longitudinally separated from the intermediate attachment position. For a power hand tool having a housing including a cylindrical outer surface portion coaxially aligned with the drive shaft of the power tool, the attachment portion of the accessory includes a corresponding concavity for being installed about the cylindrical portion of the housing in nesting relationship with a clearance fit therebetween to allow for angular adjustment therebetween.

35 Claims, 2 Drawing Sheets

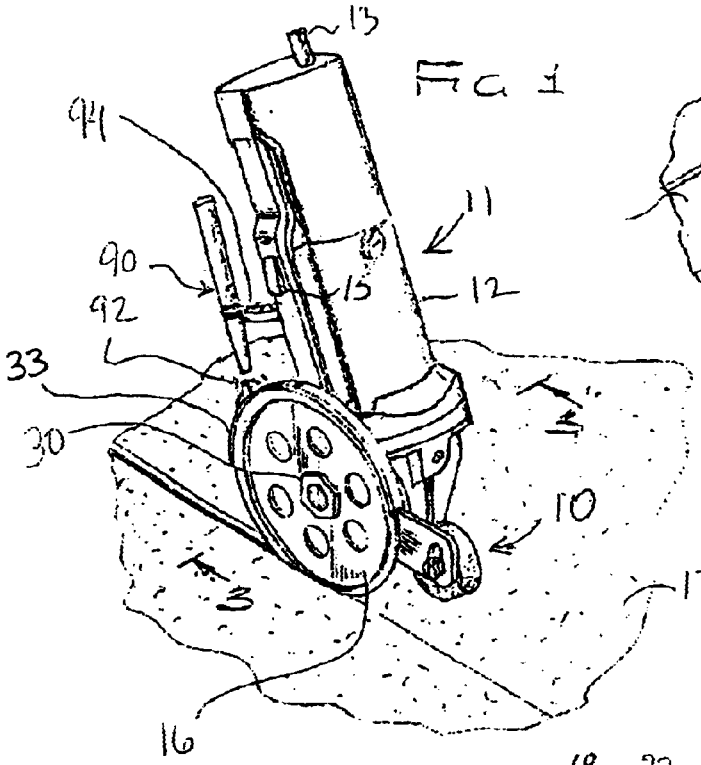
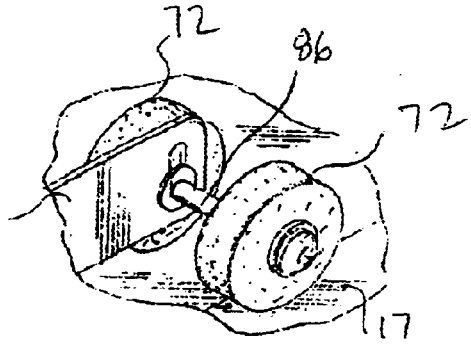
FIG 6
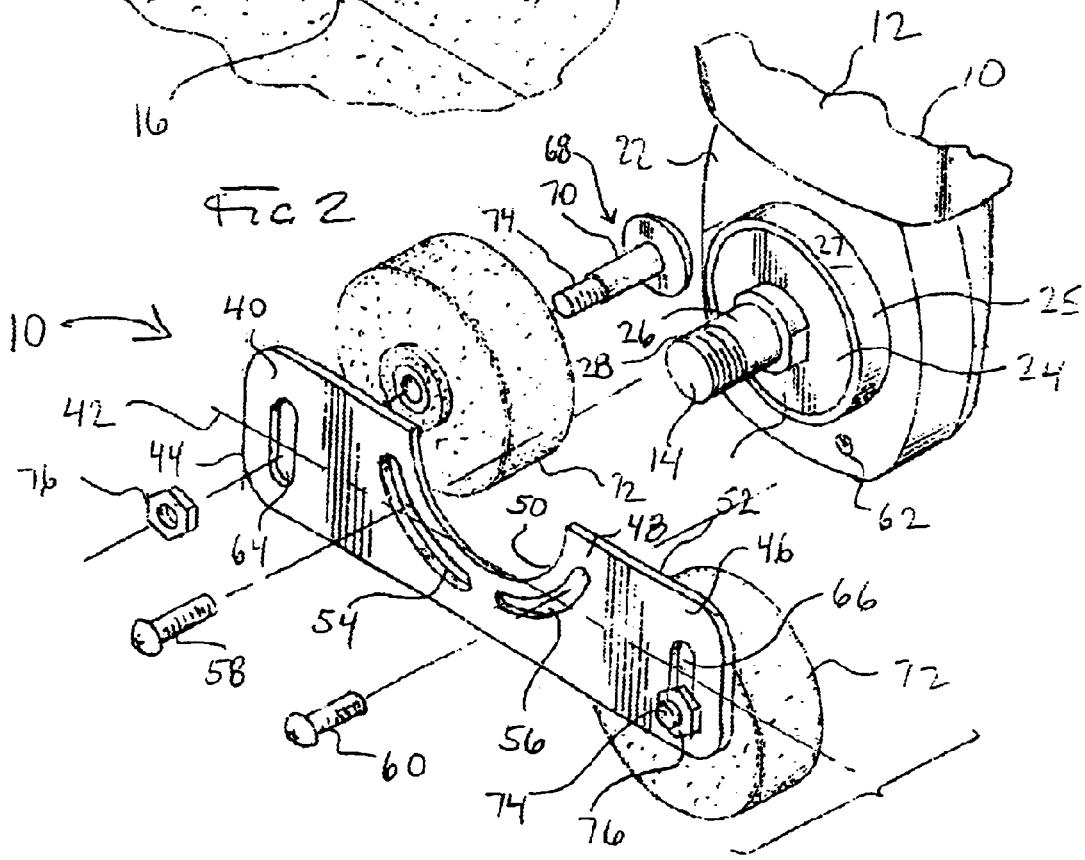

SUPPORT ACCESSORY FOR POWER HAND TOOL

CROSS-REFERENCE TO RELATED APPLICATIONS not applicable

STATEMENT RE: FEDERALLY SPONSORED RESEARCH/DEVELOPMENT not applicable

BACKGROUND OF THE INVENTION

1. Field of the Invention

The present invention relates to hand tools, and more particularly, to an accessory for supporting and thereby enhancing the use and performance of hand tools during material processing of a substrate.

2. Description of the Related Art

Hand tools, especially power-assisted hand tools are well known and widely used in the construction, retrofitting or repair of solid surfaces and articles, such as by the selective removal of material in order to produce a desired contour, relief, conformation or shape as by grinding or sanding. For example, a builder may selectively grind a groove into a concrete surface to form a thermal relief, or sand some wood from a beam in order to produce a neat fit, or grind or sand away a contour to smooth or reconfigure a surface or edge. The procedure of such selective removal, particularly if carried out by abrasive means, involves the expenditure of considerable physical effort, as the required grinder or sander itself may have considerable weight, is typically awkward and clumsy to work with, without benefit of a stabilizing platform or guide not common to such hand tools, and contrary to the need for compactness and portability. Over the course of performing what is typically a physically arduous task in oftentimes challenging work environments, there is an increased possibility of reduced accuracy and consistency in providing the grinding/sanding operation because of the lack of a stabilizing or guiding platform.

More specifically, hand-held tools and especially power tools such as disc grinders employ grinding wheels and cut-off wheels with grinding surfaces or sharpened cutting edges or teeth for grinding, sanding, or cutting all manner of stone, masonry, wood and other material that may be provided in block, sheet, slab or other forms. For example, disc grinders may be used to cut slotted or grooved reliefs at predetermined intervals in solid surfaces such as concrete to serve as stress reliefs during curing and thereafter when the concrete may expand and contract in response to thermal loads provided internally during curing and externally in response to environmental factors. Slots and grooves may be cut through the thickness of the concrete slab to serve as expansion/contraction joints. Alternatively, the slab may be provided with grooves to a subsurface depth, but not the complete depth of the slab for several purposes. One purpose is to serve as scoring lines for separation or demolition purposes. Another purpose is to serve as localized centers for cracking and crazing within the slot so provided, thereby minimizing or preventing the appearance of thermal cracking/crazing at the surface of the slab. Such hand tools may also be used for shaping and cutting other hard and durable material in sheet, slab or other forms, both natural and artificial, including granite, marble, stone and wood, as well as artificially formed materials including slab or sheet stock of solid surfacing materials commonly used for applications including but not limited to foundations, flooring, counter tops, and roofing. Due to the nature of these applications, conventional portable, hand-held power tools are necessarily built with a strong and durable construction, and are hence heavy and cumbersome, requiring significant strength, agility and endurance by the technician or operator for continuing use especially on extended or elaborate projects.

An important problem in the related art, as noted above, is that the technician must continuously balance the tool while guiding it during the material processing operation for essentially the entirety of the cut, so that the grinding wheel remains in substantially the same orientation while in contact with the underlying substrate to achieve the desired cut. The nature of this work again requires considerable strength, endurance and precision, and even a slight loss of any of these attributes by the technician or operator typically results in waste and spoilage of the stock material being cut, in addition to the lost labor and commensurate losses in production time and output. This problem is especially acute in the concrete cutting industry, where the substrate being worked is often large cast-in-place slabs for which inaccurate scored relief lines and grooves can materially and negatively affect subsequent construction requirements, and wherein the cutting saws may be of commercial grade with a commensurately greater weight than those saws provided on the consumer retail level. A related problem is maintaining an accurate cut when guiding the power tool over a surface featuring undulations or other features that challenges the technician or operator in maintaining a perfect cut through the substrate.

Accordingly, there exists a need for an apparatus that enhances the use and performance of portable power tools used in all manner of performing cuts, slots and grooves, and overcomes the substantial shortcomings of the prior art, while maintaining portability and compactness of the portable power tool.

OBJECTS AND SUMMARY OF THE INVENTION

Accordingly, it is an object of the present invention to provide an apparatus for supporting and stabilizing a portable power tool saw to improve operating precision.

It is another object of the present invention to provide an improvement for supporting a portable power tool that may easily and conveniently be retrofitted to conventional portable power tools such as power disc grinders, sanders, and other hand-held power tools for which improved and consistent handling characteristics are desirable.

It is a further object of the present invention to provide an improvement for supporting a portable power tool that is easily and readily affixed and removed by the professional and amateur alike, and once properly installed with the cutting saw, provides consistent cutting results irrespective of a user's strength or endurance.

It is yet another object of the present invention to provide a support accessory for a power hand tool that is operably affixed to and supported by the hand tool in a manner that negligibly effects its portability and compactness.

It is a further object of the present invention to provide a power hand tool constructed with the present invention.

According to the present invention, an accessory for a power hand tool overcomes the shortcomings of the related art by providing a rolling support structure that enhances ease of handling and operation of the power hand tool for supporting and carrying the hand tool over a substrate at a user-selected or preselected working depth or height of the disc grinder or sander or similar material processor. The accessory includes a support bracket having a longitudinal axis, for attachment to a portion of the housing at an intermediate to position of the support bracket, and a pair of low-friction surface engaging devices such as rollers secured to the support bracket at mounting locations longitudinally separated from the intermediate attachment position. As is common to many power hand tools, the tool housing includes a cylindrical housing portion through which the drive shaft extends for supporting the disc grinding wheel or sanding wheel. The inventive apparatus thus includes a corresponding concavity for being installed about the cylindrical portion of the housing in nesting relationship with a clearance fit or sliding fit therebetween to allow for angular adjustment therebetween.

A curvilinear fastener slot is provided in the support bracket parallel to and radially outwardly spaced from the concavity of the support bracket, and is used to secure the support bracket to the housing at a desired position, when the power tool is adjusted to the desired angular position and vertical height relative to the substrate to be processed, by a fastener securing the support bracket to the housing. Additionally, the rollers are carried on axles supported by the support bracket, and axle mounting slots are provided in the support bracket, each slot being at an angle offset from the longitudinal axis for selectively adjusting the vertical processing position of the material processing disc relative to a substrate when the accessory is mounted to the housing.

A power hand tool constructed with the invention is further disclosed. The tool is driven by an internal (e.g. electric) or external (e.g. compressed air) power source, the tool having a housing supporting a drive shaft driven by the power source, a material processing disc such as a grinding wheel or sanding wheel supported by the drive shaft for operation about a rotational axis, and a support bracket having a longitudinal axis supported by the housing at an intermediate position of the support bracket, with a pair of surface engaging rollers secured to the support bracket at mounting locations longitudinally separated from the intermediate attachment position.

According to the invention, the support bracket may be removably secured to the tool, or integrally formed therewith. Furthermore, for a power hand tool having a cylindrical bearing surface incorporated in its housing, the support bracket includes a corresponding concavity having an axis of rotation for being installed in nesting relationship with the bearing surface. The invention further exploits the type and location of fasteners securing the housings of some power hand tools, whereby the support bracket is secured to the tool by a fastener common to the tool adjacent the housing portion through which the drive shaft projects, further allowing for adjustment of the support bracket in an arcuate manner to a selected position and then securing the bracket by the common fastener. Alternatively, for a power hand tool having a face through which the drive shaft extends, and a drive shaft retaining bracket offset therefrom, a portion of the support bracket is received and supported therebetween in the installed condition.

The rollers used with the support bracket are carried on axles extending from the support bracket, the axles being positionally adjustable in axle mounting slots provided in the support bracket, each slot provided at an angle offset from the longitudinal axis for selectively adjusting the vertical processing to position of the material processing disc relative to a substrate. According to one embodiment of the invention, the offset angle is perpendicular to the longitudinal axis, although other mounting slots with alternate configurations may be provided. Furthermore, to provide additional stability during use of the power hand tool, a pair of rollers may be supported on at least one of the shafts (or even both, if desired), wherein the shaft extends to opposite sides of the support bracket for supporting the rollers in opposing relationship and providing a relatively wide support base.

It should be noted and understood that with respect to the embodiments of the present invention disclosed herein, the materials and apparatus disclosed and suggested may be modified or substituted to achieve the desired protected structures without departing from the scope and spirit of the disclosed and claimed invention.

BRIEF DESCRIPTION OF THE DRAWINGS

FIG. 1 is a perspective view of a power hand tool to which the support accessory of the present invention is installed, showing the disc grinding wheel of the tool being selectively applied to a substrate to form a groove at a user-selected depth.

FIG. 2 is an exploded view of the support accessory of the present invention to be mounted to a power tool.

FIG. 6 is a partial perspective view of an additional feature of the present invention, showing a pair of rollers supported on an axle extending from one end of the support bracket to provide additional stability during operation of the power hand tool.

DETAILED DESCRIPTION OF THE PREFERRED EMBODIMENTS

Figure 3:
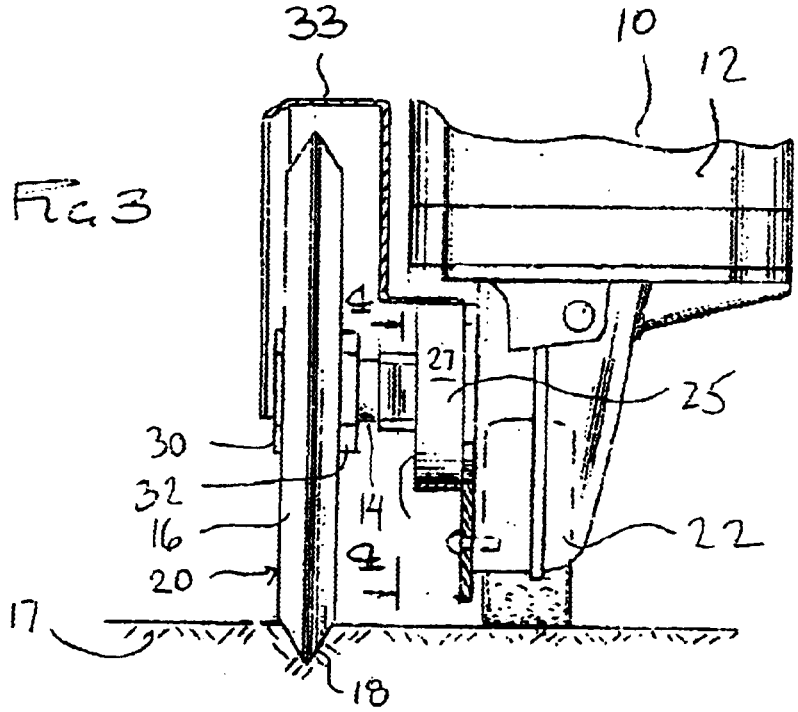
FIG. 3 is a partial front elevational view of the support accessory of the present invention shown in FIG. 1.

Referring now to the drawings wherein like numerals designate like and corresponding parts throughout the several views, FIGS. 1–3 show the support accessory 10 of the present invention mounted to a portable power hand tool 11 such as a power disc grinder or sander or other power hand tool having a housing 12 configured to contain an internal power drive such as an electric motor energized by an electrical source connected to power conduit 13 or alternatively by a transmission for accommodating an external compressed air supply provided through power conduit 13 as is commonly known. The power drive provides a power output to a drive shaft 14 after the tool 11 is activated by switch 15, the tool being configured to securely support, engage and drive via rotary motion a material processing disc 16 such as a grinding wheel, sanding wheel, cutoff wheel, flap wheel or other surface processing or conditioning disc for engaging and processing a substrate 17. It will be appreciated that the disc 16 may include a peripheral cutting or processing edge 18, or alternatively, a material processing surface provided on the exposed lateral face 20 of the disc 16.

The housing 12 includes a housing extension 22 through which the drive shaft 14 extends, the housing extension 22 further including a bearing face 24 fronting a standoff portion 25 having a cylindrical periphery 27 through which the drive shaft 14 further extends to receive and support the disc 16. Drive shaft 14 includes a base portion 26 projecting from the housing extension 22 and a threaded distal portion 28 for receiving bracketing securing nuts 30, 32 and thereby securing the disc 16 therebetween. According to one mode of operation, typically a grinding or cutting mode, an edge guard 33 may be secured to the housing 12 to encompass a circumferential aspect of the arc of rotation of the disc 16 opposite from the circumferential working aspect of the disc 16. Alternatively, the edge guard 33 may be removed to enable direct application of the exposed lateral face 20 of the disc 16.

Referring specifically now to FIG. 2, and according to the invention, support accessory 10 includes a support bracket 40 having a longitudinal axis 42 extending along its substantially rectilinear extent defined by two end portions 44, 46 bridged by a center web portion 48. A shaped concavity 50 is provided in the center web portion 48 extending through one lateral edge 52. Shaped concavity 50 is configured to conform with cylindrical periphery 27 of the power hand tool 11 in the manner to be more fully described below. A pair of arcuately shaped fastener slots 54, 56 are also provided in the support bracket 40 for securing it to the housing extension 22 by fasteners 58, 60 projected therethrough to engage in threaded recesses 62 also provided in the housing extension 22. Fasteners 58, 60 may be provided with the tool 11 for fastening portions of the housing extension 22 to housing 12, and these fasteners 58, 60 are used in common to secure the support bracket 40 to the tool 11 according to the invention, although it will be apparent to the skilled artisan that additional fasteners not included in the basic construction of the tool 11 may be optionally provided or substituted to serve the function of securing the support bracket 40 to the tool 11 according to the invention. Fastener slots 54, 56 share a common radius relative to the axial center of shaped concavity 50, and may optionally be fabricated as a unitary slot (not shown) by removal of the separating structure. Support bracket 40 may be constructed of a strong, rigid material such as a stainless steel or aluminum alloy or other suitable material that can suitably absorb the shock, vibration and other loads commonly endured during reasonable use of the designated power hand tool.

Each of the two end portions 44, 46 include slots 64, 66, respectively, through which is secured a shaft bolt 68 having a roller bearing surface 70 for supporting a substrate surface engaging roller 72. The shaft bolt 68 includes a distal threaded portion 74 for receiving a retaining nut 76 thereby allowing for securing each roller 72 to a selected lateral side of support bracket 40. Slots 64, 66 are provided in the support bracket 40 at an angle offset from the longitudinal axis 42 for selectively adjusting the vertical processing position of the material processing disc 16 relative to the relative to the substrate 17 in the installed position. According to the invention, and as shown in FIG. 2, the offset angle is perpendicular to the longitudinal axis 42, although slots 64, 66 provided at other angles and configurations relative to the longitudinal axis 42 may be provided such as by forming or stamping in the support bracket 40. By way of example only, slots 64, 66 may have an extended or articulated configuration so as to provided an element of adjustability of a roller 72 in the direction of the longitudinal axis 42, while concurrently providing an element of adjustability transverse thereto.

Figure 4:
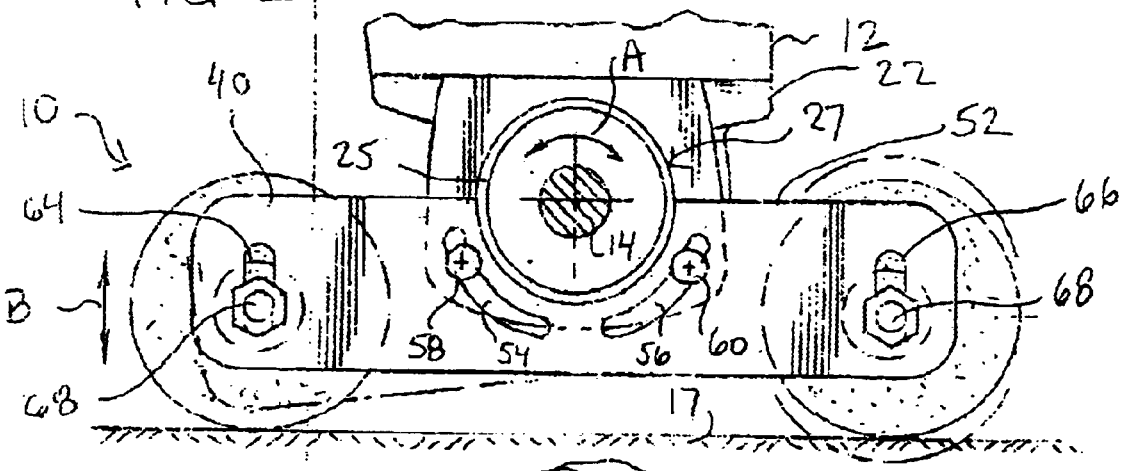
FIG. 4 is a side elevational view of the support accessory shown in FIG. 3, showing the positional adjustability of the inventive apparatus relative to the power hand tool to which it is mounted.

With particular reference now to FIGS. 3 and 4, the inventive support accessory 10 is shown mounted for operation to the power hand tool 11, further showing the adjustability of the accessory 10 to articulate the tool 11 and disc 16 to a selected operational angle and height relative to the substrate 17. More specifically, support bracket 40 is fitted to the tool 11 by sliding the support bracket between the disc 16 and bearing face 24 while engaging the standoff portion 25 in the concavity 50 with a sliding or clearance fit between the cylindrical periphery or bearing surface 27 and the support bracket 40. In the installed, nested position, the concavity 50 and cylindrical periphery 27 have a common an axis of rotation, and are angularly adjusted in the direction of arrow A (FIG. 4) to achieve the desired handling angle of the power hand tool 11. The desired position is then secured by assembling and tightening fasteners 58, 60 in threaded recesses 62.

Vertical adjustment of the assembly is achieved by raising or lowering each or both rollers 72 in slots 64, 66 in the direction of arrow B (FIG. 4) to achieve a selected processing depth for the disc 16, thereby also achieving another objective of the invention, i.e., providing means for maintaining a consistent processing depth relative to a substrate, even one with undulating and inconsistent contours. Thus, angular orientation of the tool 11 relative to the longitudinal axis 42 may be achieved either by angular adjustment of the tool 11 within the concavity 50, and/or by separate height adjustment of the rollers 72 in the manner described. Furthermore, it will be clear that although a generally cylindrical periphery 27 is shown, it will be apparent to the skilled artisan that an actual bearing relationship between the periphery 27 and concavity need not be maintained to achieve the objectives of the present invention. Indeed, it is contemplated that one or both surfaces may be proved with a plurality of spaced teeth to further engage and secure a desired angular orientation of the tool 11 relative to the longitudinal axis 42 and hence support bracket 40.

According to the invention, the support accessory 10 may be provided either as an accessory to a power hand tool that may be easily and readily assembled or disassembled thereto, or alternatively provided as a feature of and manufactured with a power hand tool. More particularly, the power hand tool 11 may be driven by a power source having a housing 12 supporting a drive shaft 14 driven by an internal or external power source, a material processing disc 16 supported by the drive shaft 14 for operation about a rotational axis, a support bracket 40 being supported for articulation by the housing 12 at a position of the support bracket 40, and a pair of surface engaging rollers 72 secured to the support bracket 40 at mounting position separated from the intermediate attachment position.

Figure 5:
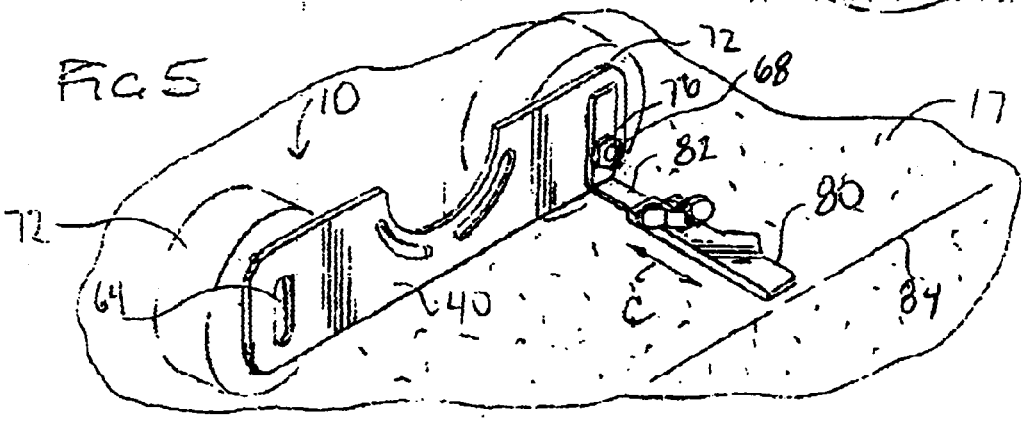
FIG. 5 is a perspective view of the support accessory of the present invention, further showing an alignment gauge for use therewith.

Referring to FIGS. 5 and 6, additional features of the present invention are disclosed. As shown in FIG. 5, an alignment/sight gage such as an extendable ruler 80 supported by an L-bracket 82 is supported by installed fastener 74 and nut is 76 at forward end portion 44 of support bracket 40 to provide measuring guidance of the disc 16 relative to a reference line or contour 84 to the power tool operator. It will be apparent to the skilled artisan that other alignment and measuring tools may be secured to the support bracket 40 as necessary and desired to assist the operator in achieving positional and depth consistency during operation of the tool. As shown in FIG. 6, to provide additional stability during use of the power hand tool 11, a pair of rollers 72 may be supported on an extended roller supporting axle 86 to substitute for one or both shaft bolts 68 adjustably secured to slots 64, 66 and adjustable in the same manner previously described, the rollers 72 supported on opposite sides of the support bracket 40 to provide at least a tripod support structure to support the assembly of the tool 11 and accessory 10 in an upright position, as well as to provide a relatively wide support base for the assembly during operation and storage. In addition, and with reference to FIG. 1, a cooling water sprayer 90 for providing a directable cooling water spray 92 toward the work piece and disc 16 may be affixed to the tool 11 by a clamp 94 at the appropriate position and height.

It is to be understood that the present invention is not limited to the embodiments described above, but encompasses any and all embodiments within the scope of the following claims.

What I claim is:

1. An accessory for a power hand tool having a housing, the tool having a material processor supported for rotation about an axis by a drive motor, the accessory comprising:

a support bracket having a longitudinal axis, for attachment to at least a portion of the housing at an intermediate point of the support bracket; and a pair of surface engaging stabilizer members secured to the support bracket at mounting locations longitudinally separated from the intermediate attachment point;

wherein the support bracket includes an attachment portion shaped complementary to a portion of the housing; and wherein the portion of the housing includes a cylindrical outer surface, and the attachment portion includes a corresponding concavity for being installed about the portion of the housing in nesting relationship with a clearance fit therebetween to allow for angular adjustment therebetween coaxial with the axis of rotation of the material processor.

2. The accessory recited in claim 1, further comprising a fastener slot provided in the support bracket for securing the support bracket to the housing at a position.

3. The accessory recited in claim 2, wherein the fastener slot is curvilinear, the support bracket being selectively angularly oriented about the axis and secured at the selected angular orientation by a fastener securing the support bracket to the housing for selectively adjusting the angular processing position of the material processor relative to a substrate.

4. The accessory recited in claim 3, wherein the fastener slot has a constant radius about which the support bracket is angularly adjusted.

5. The accessory recited in claim 3, wherein the fastener slot is bifurcated.

6. The accessory recited in claim 1, wherein the support bracket is secured to the housing by a fastener common to the tool.

7. The accessory recited in claim 1, wherein the stabilizer members are rollers oriented for rotation in a direction parallel to the longitudinal axis.

8. The accessory recited in claim 7, wherein the rollers are mounted to support shafts supported by the support bracket, the support shafts being selectively adjustable relative to the longitudinal axis.

9. The accessory recited in claim 8, further comprising shaft mounting slots provided in the support bracket at an angle offset from the longitudinal axis for selectively adjusting the vertical processing position of the material processor relative to a substrate when the accessory is mounted to the housing.

10. The accessory recited in claim 9, wherein the offset angle is perpendicular to the longitudinal axis.

11. The accessory recited in claim 8, further comprising a pair of rollers supported on at least one of said shafts.

12. The accessory recited in claim 11, wherein the shaft extends to opposite sides of the support bracket for supporting the rollers in opposing relationship.

13. The accessory recited in claim 1, further comprising a fluid cooling apparatus for use therewith.

14. An accessory for a power hand tool having a housing, the tool having a material processing disc supported by a drive shaft having a rotational axis, the accessory comprising:

a support bracket having a longitudinal axis, for attachment to a portion of the housing at an intermediate position of the support bracket; and a pair of surface engaging rollers secured to the support bracket at mounting locations longitudinally separated from the intermediate attachment position;

wherein the portion of the housing includes a cylindrical outer surface, and the attachment portion includes a corresponding concavity for being installed about the portion of the housing in nesting relationship with a clearance fit therebetween to allow for angular adjustment therebetween.

15. The accessory recited in claim 14, wherein the support bracket is attached to a portion of the housing by a fastener common to the tool.

16. The accessory recited in claim 14, wherein the housing includes a face and a drive shaft retaining bracket offset therefrom for: receiving and retaining a portion of the support bracket therebetween in the installed condition.

17. The accessory recited in claim 14, further comprising a fastener slot provided in the support bracket for securing the support bracket to the housing at a position.

18. The accessory recited in claim 17, wherein the fastener slot is curvilinear, the support bracket being selectively angularly oriented about the axis and secured at the selected angular orientation by a fastener securing the support bracket to the housing for selectively adjusting the angular processing position of the material processor relative to a substrate.

19. The accessory recited in claim 18, wherein the fastener slot has a constant radius about which the support bracket is angularly adjusted.

20. The accessory recited in claim 14, further comprising axles for carrying the rollers, and axle mounting slots provided in the support bracket, each slot being at an angle offset from the longitudinal axis for selectively adjusting the vertical processing position of the material processing disc relative to a substrate when the accessory is mounted to the housing.

21. The accessory recited in claim 20, wherein the offset angle is perpendicular to the longitudinal axis.

22. The accessory recited in claim 14, further comprising a fluid cooling apparatus for use therewith.

23. A power hand tool driven by a power source, comprising:

a housing supporting a drive shaft driven by the power source;

a material processing disc supported by the drive shaft for operation about a rotational axis;

a support bracket having a longitudinal axis supported by the housing at an intermediate position of the support bracket; and a pair of surface engaging rollers secured to the support bracket at mounting positions longitudinally separated from the intermediate attachment position;

wherein the support bracket is removably secured to the tool; and wherein the tool includes a cylindrical bearing surface, and the support bracket includes a corresponding concavity having an axis of rotation for being installed in nesting relationship with the bearing surface.

24. The power hand tool recited in claim 23, wherein the power source is internal to the tool.

25. The power hand tool recited in claim 23, wherein the power source is external to the tool.

26. The power hand tool recited in claim 23, wherein the support bracket is secured to the tool by a fastener common to the tool.

27. The power hand tool recited in claim 23, wherein the tool includes a face through which the drive shaft extends, and.a drive shaft retaining bracket offset therefrom for receiving and retaining a portion of the support bracket therebetween in the installed condition.

28. The power hand tool recited in claim 23, further comprising a fastener slot provided in the support bracket for securing the support bracket to the housing at a position with a fastener.

29. The power hand tool recited in claim 28, wherein the fastener slot is curvilinear, the support bracket being selectively angularly oriented about its axis of rotation and secured at the selected angular orientation by the fastener securing the support bracket to the housing for selectively adjusting the angular processing position of the material processor relative to a substrate.

30. The accessory recited in claim 29, wherein the fastener slot has a constant radius about which the support bracket is angularly adjusted.

31. The power hand tool recited in claim 23, further comprising axles for carrying the rollers, and axle mounting slots provided in the support bracket, each slot being at an angle offset from the longitudinal axis for selectively adjusting the vertical processing position of the material processing disc relative to a substrate.

32. The power hand tool recited in claim 31, wherein the offset angle is perpendicular to the longitudinal axis.

33. The power hand tool recited in claim 31, further comprising a pair of rollers supported on at least one of said shafts.

34. The power hand tool recited in claim 33, wherein the shaft extends to opposite sides of the support bracket for supporting the rollers in opposing relationship.

35. The power hand tool recited in claim 23, further comprising a fluid cooling apparatus for use therewith.

* * * * *